United States Patent [19]

Benteler et al.

[11] 4,237,713

[45] Dec. 9, 1980

[54] APPARATUS FOR PRODUCING A TUBE WITH SUCCESSIVE CORRUGATIONS

[75] Inventors: Hubertus Benteler, Bielefeld; Egon Olszewski; Rainer Hansen, both of Paderborn-Elsen; Ferdinand Wecker, Paderborn-Sennelager, all of Fed. Rep. of Germany

[73] Assignee: Benteler-Werke AG, Paderborn, Fed. Rep. of Germany

[21] Appl. No.: 40,275

[22] Filed: May 18, 1979

[30] Foreign Application Priority Data

Dec. 1, 1978 [DE] Fed. Rep. of Germany ..... 2851944

[51] Int. Cl.[3] ..... B21D 15/06

[52] U.S. Cl. ..... 72/59; 72/62; 72/370

[58] Field of Search ..... 72/59, 62, 63, 370; 29/44 R

[56] References Cited

U.S. PATENT DOCUMENTS

| | | | |
|---|---|---|---|
| 2,773,538 | 12/1956 | De Mers | 72/59 |
| 2,954,064 | 9/1960 | De Mers | 72/59 |
| 2,960,014 | 11/1960 | Rutter | 72/59 |
| 3,083,754 | 4/1964 | De Mers | 72/59 |
| 3,130,771 | 4/1964 | Peyton | 72/59 |

*Primary Examiner*—Leon Gilden

*Attorney, Agent, or Firm*—Michael J. Striker

[57] ABSTRACT

Apparatus for producing a tube with successive corrugations from a tubular blank of constant diameter comprises a central pin having a shaft portion fixed only at one end to a stationary support and having at the other end a radially enlarged head portion cooperating with radially inwardly moving clamping and forming jaws to clamp a portion of a tubular blank therebetween. The apparatus includes further a tubular member guided on the shaft portion of the central pin and movable in axial direction by hydraulically operated members connected thereto. The tubular member supporting a blank on the inner surface thereof and cooperating with a plurality of clamping fingers arranged axially spaced from said head portion about the outer circumference of the blank and movable by a hydraulically operated clamping piston between a clamping and a releasing position, whereby between the head portion, one end of the tubular member and the clamped portions of the blank an annular expansion chamber is formed into which fluid under pressure may be fed through bores in the central pin.

12 Claims, 9 Drawing Figures

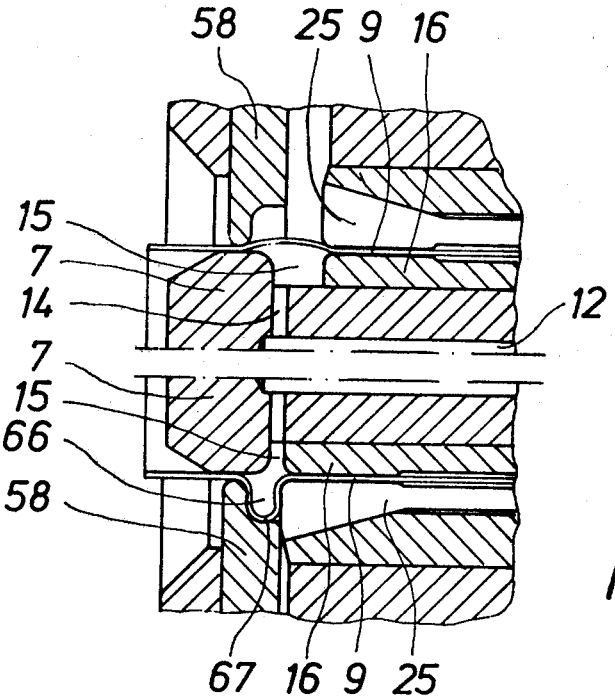
Fig.3
Fig.4
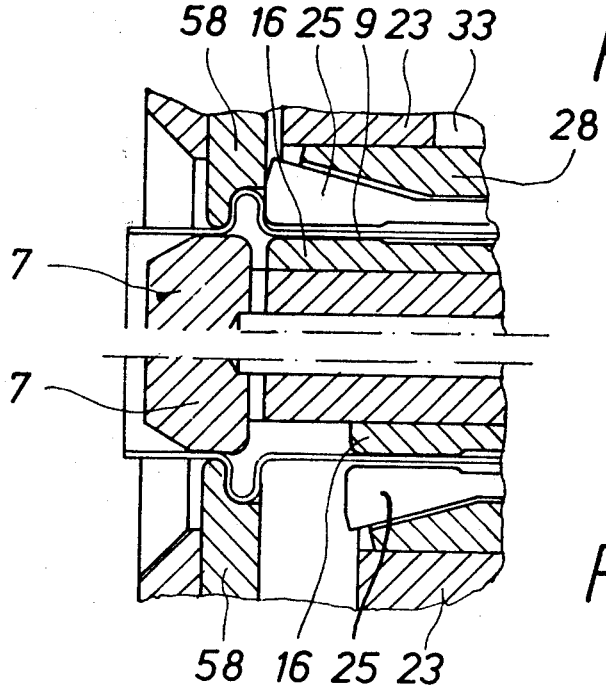
Fig.5
Fig.6

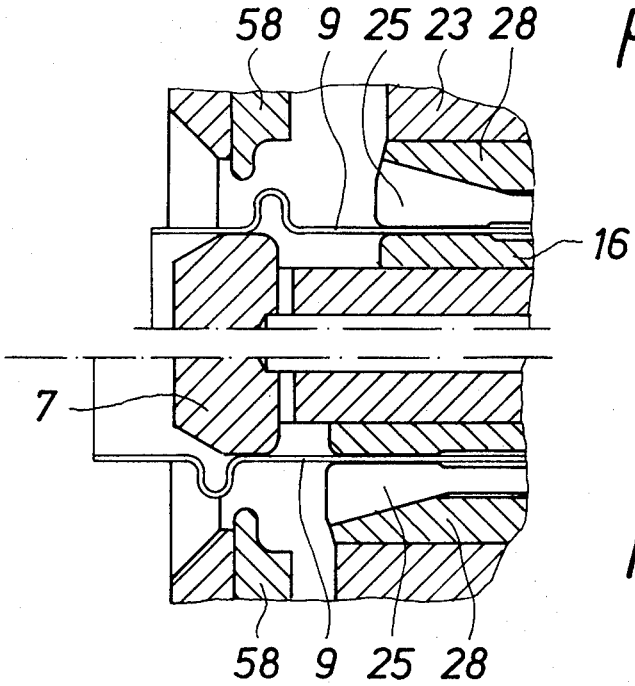
Fig. 7
Fig. 8
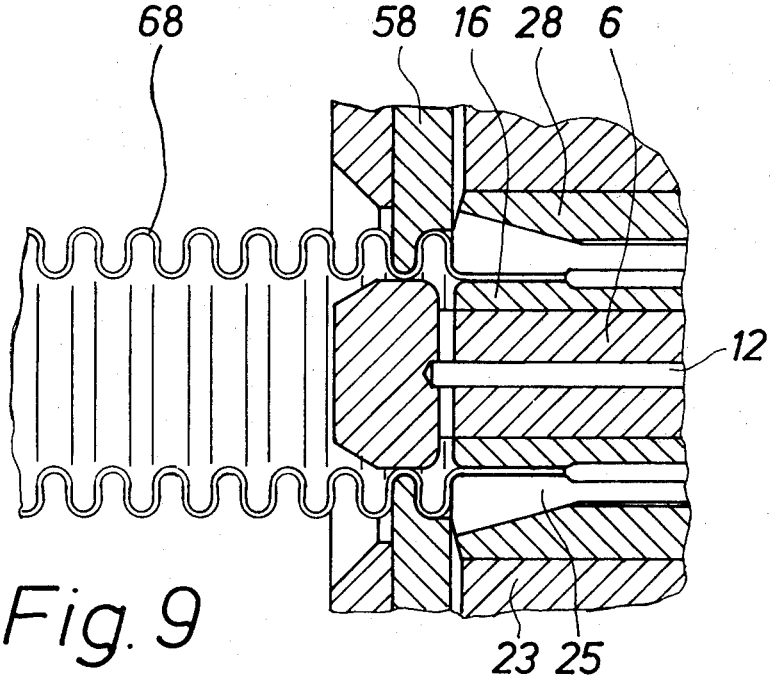
Fig. 9

APPARATUS FOR PRODUCING A TUBE WITH SUCCESSIVE CORRUGATIONS

BACKGROUND OF THE INVENTION

The present invention relates to an apparatus for producing a tube with successive corrugations of substantially uniform configuration and wall thickness from a tubular blank of constant diameter.

The DE-AS 13 03 671 discloses an apparatus for continuous production of annular corrugations on a tubular blank of constant diameter. This apparatus comprises a stationarily mounted vertically arranged core pin which is provided with an axially extending hollow section for guiding a multiple part tube mandrel as well as a piston-like enlargement at the free end of the shaft section, which forms an abutment for radially movable, hydraulically operated holding and forming jaws. After pushing a smooth-walled tubular blank onto the core pin, the holding and forming jaws are first moved in engagement with the blank to press the latter against the piston-like enlargement. Subsequently thereto, clamping jaws are pressed by means of radially arranged hydraulically operated cylinder-and-piston units connected with the mandrel against the blank, whereby the mandrel supports the blank inwardly at the region of the clamping jaws. Between the piston-like enlargement, the tubular mandrel and the tubular blank there is now formed an annular expansion space which is impinged by pressure fluid fed into the space through the hollow shaft and a crossbore, so that the wall of the tubular blank bulges outwardly. After the bulge reaches a predetermined dimension, the tubular mandrel together with the clamping jaws and the clamped blank is moved by means of hydraulically operated cylinder-and-piston units arranged parallel to the core pin in direction toward the piston-like enlargement, whereby the tubular wall is expanded and an annular corrugation is formed.

A disadvantage of this known apparatus is the necessary sealing of the expansion space in the region of the piston-like enlargement and that of the tubular mandrel. Sealing rings of elastic material are provided for this purpose, which are axially compressed to thus be radially deformed and pressed against the inner surface of the tubular blank, respectively against the previously produced corrugation. The compression of the seal in the region of the piston-like enlargement and that of the tubular mandrel is produced by cylinder-and-piston systems which are axially displaced by hydraulic fluid. The elastic seals are, during forming of corrugations in the blank, continuously compressed and again released, so that the material will necessarily fatigue, respectively be worn, which will result in leakage, and in addition the cylinder-and-piston units for the compression of the elastic seals have to be properly sealed.

The therewith-connected necessary exact fits and seals considerably increase the manufacturing cost. In addition, increased maintenance cost is necessary in order to assure a proper function of this apparatus. Especially disadvantageous in this known construction is the necessary feeding of the hydraulic fluid to the cylinder-and-piston unit in the multipart tube mandrel. For this purpose, there is provided in the hollow shaft an additional tube. It is also of disadvantage that the cylinder-and-piston unit in the piston-like enlargement is to be supplied with hydraulic pressure fluid. For this purpose an additional conduit is provided at the outer end of the piston-like enlargement. This necessary additional tube will complicate the removal of a finished corrugated tube, as well as the placement of a new tubular blank into the apparatus. An automatic feeding of the blanks is, therefore, impossible. In addition, the known apparatus needs, due to its construction, a large installation space.

SUMMARY OF THE INVENTION

It is an object of the present invention to provide an apparatus for producing a tube with successive corrugations of uniform configuration and wall thickness from a tubular blank of constant diameter which avoids the disadvantages of such apparatus known in the art.

It is a further object of the present invention to provide an apparatus of the aforementioned kind which is compacter than such apparatus known in the art.

It is an additional object of the present invention to provide an apparatus of the aforementioned kind which is composed of relatively few and simple parts so that the apparatus will operate substantially trouble-free and can be built at reasonable cost.

It is yet an additional object of the present invention to provide an apparatus of the aforementioned kind which facilitates automatic feeding of tubular blanks into the apparatus and removal of the finished corrugated tube therefrom.

With these and other objects in view, which will become apparent as the description proceeds, the apparatus of the present invention for producing a tube with successive corrugations of uniform configuration and wall thickness from a tubular blank of constant diameter mainly comprises support means, a central pin having an elongated shaft portion fixedly attached only at one end to the support means and having a radially enlarged head portion at the other end, a tubular member mounted on the shaft portion of the central pin for movement in axial direction and adapted to support together with the head portion a tubular blank at the inner surface thereof, in which the tubular member has one end axially spaced from the head portion to form between this one end and the head portion and a blank supported thereon an expansion chamber. The apparatus includes further first clamping means comprising a plurality of hydraulically operated radially movable holding and forming jaws opposite the head portion, second clamping means comprising a plurality of circumferentially displaced radially tiltable clamping fingers of a collet arranged in the region of the one end of the tubular member about the outer circumference of the blank supported by the latter, a hydraulically operated axially movable annular clamping piston surrounding the clamping fingers for moving the latter between a clamping and a releasing position, an upsetting cylinder connected at one end to the other end of the tubular member and having opposite this one end a radially enlarged end portion surrounding and guiding the clamping piston for movement in axial direction. An axially movable corrugation cylinder surrounding part of the upsetting cylinder and being formed with an annular groove, an annular collar fixed to the upsetting cylinder and located in the aforementioned annular groove of the corrugation cylinder and forming in this groove two chambers adapted to be alternatingly filled with pressure fluid so as to axially move the upsetting cylinder relative to the corrugation cylinder, and means for feeding pressure fluid into the aforementioned expansion chamber after axially spaced portions of the blank have been clamped against the head portion and said one end of the tubular member by the first and second clamping means to thus expand a portion of the blank clamped between the first and the second clamping means into a corrugation.

This will provide a construction which, compared with the construction of the above-discussed prior-art apparatus, has only a small radial extension beyond the outer circumference of the tubular blank. Thus the apparatus can be installed in a relatively small space. Furthermore, the means for clamping the tubular blank and to advance the latter to form the corrugations are arranged closely about the tubular blank. No cylinder-and-piston units, which require closely fitted parts and seals liable to wear are provided in the interior of the tubular blank. The tubular member mounted on the shaft portion of the pin is an integral part guided along its total length on the shaft portion.

An additional advantage of the construction according to the present invention is that the central pin is mounted only at one end thereof on the support means, whereas on the other end no tube for feeding hydraulic fluid is necessary. This provides free access to the apparatus so that an automatic feeding of tubular blanks into the apparatus and removal of the finished corrugated tube are possible. The gripping of the tubular blank occurs by means of axially directed clamping fingers, which by means of a clamping piston, movable relative to the clamping fingers, are pressed against the tubular blank, so that the latter in turn is pressed against the members extending therethrough. Due to the projection of the annular collars into the corresponding annular grooves, circumferentially extending pressure chambers are formed so that by feeding pressure fluid into the latter, a predetermined displacement of the various parts in the desired direction is accomplished. The expansion space between the head portion of the central pin and the tube mandrel is sealed by simple metallic seals on the clamping and forming jaws and the clamping fingers. Additional extensive sealing systems as are necessary in the known apparatus, are avoided.

A corrugation is formed by axially displacing the upsetting cylinder relative to the corrugation cylinder, while the tubular blank is clamped and the relative movement of the two cylinders establishes the axial dimension of the corrugation.

The central pin is relatively simple in its construction since it has only a longitudinal bore and a crossbore through which the pressure fluid is fed into the expansion space.

The radially enlarged end portion of the upsetting cylinder is, according to an advantageous feature of the present invention, provided with an annular groove and the clamping piston has an annular collar guided in the annular groove and dividing the latter into two chambers adapted to alternatingly be filled with pressure fluid so as to axially move the clamping piston in one or the opposite direction to thereby move the clamping fingers between a clamping and a releasing position.

In this connection, it is also advantageous that the clamping fingers have a part-conical outer surface tapering in a direction away from the head portion and the clamping piston has a corresponding inner conical surface cooperating with the conical outer surface of the clamping fingers.

In order to obtain a properly aimed clamping force and in addition a perfect sealing effect in region of the tubular member, the latter is provided with a radially outwardly projecting annular portion, extending for a given distance in axial direction from the one end thereof, and each of the clamping fingers has a radially inwardly projecting portion opposite this radially outwardly projecting portion of the tubular member so that the blank located between the clamping fingers and the tubular member will be clamped only between the radially projecting portions. This will assure that tubular blanks of different wall thickness may be corrugated in one and the same apparatus.

A simple connection of the collet and the upsetting cylinder is obtained in that the clamping fingers are threadedly connected at the rear end thereof with the upsetting cylinder.

A further improvement is obtained in that the radially enlarged end portion of the upsetting cylinder is substantially coaxial with the corrugation cylinder to thereby reduce the axial dimension of the apparatus.

According to a further advantageous feature of the present invention, the corrugation cylinder is provided with a second annular groove, axially spaced from the first-mentioned annular groove, and the arrangement includes a sleeve fixedly connected to the support means and having an inner surface guiding the upsetting cylinder and an outer surface guiding the corrugation cylinder. The sleeve has an annular collar projecting into the second annular groove of the corrugation cylinder and dividing the annular groove into two compartments adapted to be alternatingly filled with pressure fluid so as to axially move the corrugation cylinder in one and the opposite direction relative to the sleeve.

According to a further feature of the present invention, a pair of adjusting nuts are axially adjustable connected to opposite ends of the corrugation cylinder, whereby the adjusting nut in the region of the radially enlarged end portion of the corrugation cylinder serves to adjust the compression stroke, whereas the other adjusting nut serves to steplessly adjust the distance between successive corrugations.

The support means for the one end of the central pin preferably comprise a cover connected to one end of a cylindrical housing closely surrounding the corrugation cylinder and the radial enlargement of the upsetting cylinder and carrying at the other end a plurality of housings in which the holding and forming jaws are respectively guided for movement in radial direction.

According to a further feature of the present invention, each of the holding and forming jaws has a nose-like projection cooperating with the head portion of the central pin for clamping a tubular blank therebetween and each of the jaws is provided on the side of this projection facing the clamping fingers with a cutout forming together with end faces of the clamping fingers a space for forming a corrugation.

The tubular member is threadedly connected at the other end thereof to the upsetting cylinder which forms a simple connection of these two elements.

The construction of the corrugation cylinder may be carried out in different ways. Preferably, the corrugation cylinder is formed of three coaxially connected annular sections. In this way the manufacture of the corrugation cylinder is simplified and the assembly of the three sections can, for instance, be accomplished by threaded connections or by press fits.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIGS. 3–9 illustrate vertical cross-sections through the apparatus in the region thereof in which the corrugations are formed at an enlarged scale and respectively showing successive positions of the various elements during forming of a corrugation.

DESCRIPTION OF THE PREFERRED EMBODIMENTS

Figure 1:
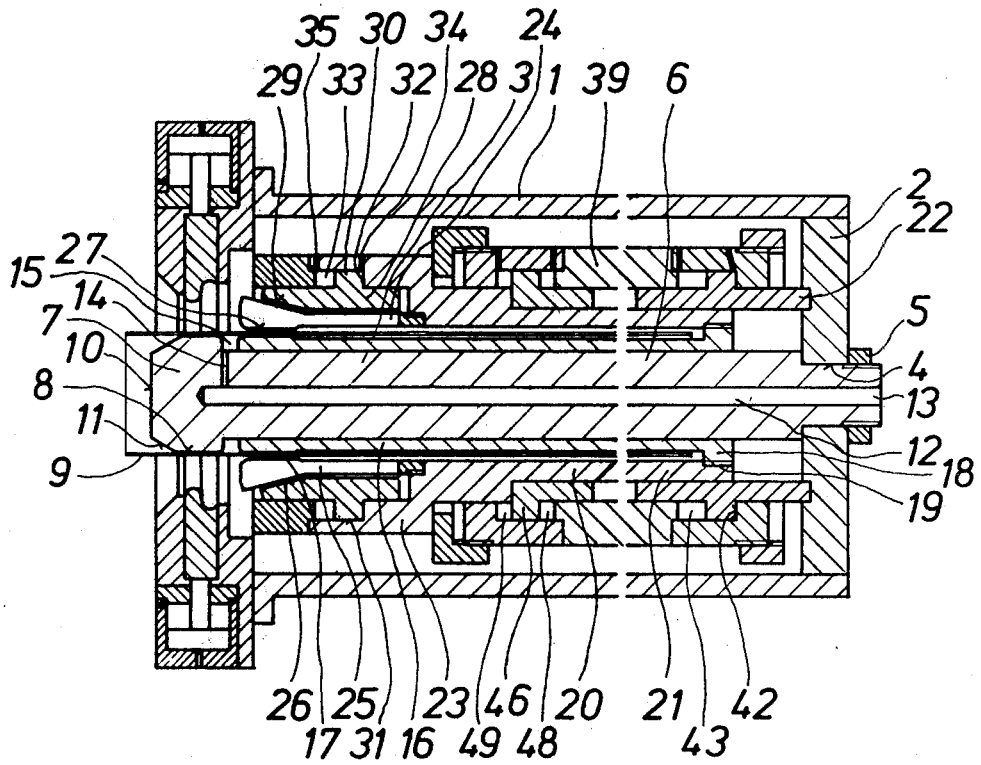
FIG. 1 is a vertical axial cross-section through the apparatus of the present invention.
Figure 2:
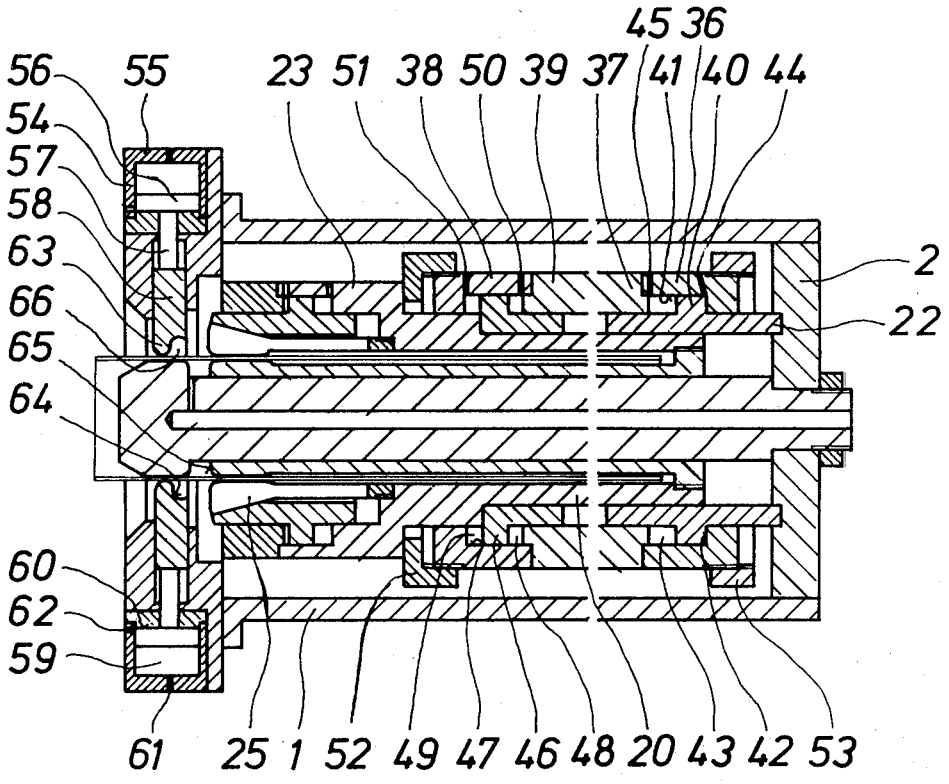
FIG. 2 is a cross-section similar to that of FIG. 1, but showing some of the elements of the apparatus in a different position.

The apparatus illustrated in vertical cross-section in FIGS. 1 and 2 serves to produce a corrugated tube, which may, for instance, be used as part of a steering column of an automobile.

As shown in these two Figures, the apparatus comprises a cylindrical housing 1, which is closed at one end by a cover 2. The cover 2 serves to mount a central pin 3 extending in axial direction through the housing. The central pin 3 has at its right end, as viewed in the drawing, a reduced diameter portion, which extends with a close fit through a corresponding bore 4 in the cover, and a nut 5 screwed onto the outer threaded end of the reduced diameter portion presses the shoulder formed at the inner end of the reduced diameter portion of the pin 3 against the cover 2, to thus fix the axial position of the central pin.

The central pin 3 has a relatively long cylindrical shaft portion 6 and a piston-shaped head portion 7. The head portion 7 has a cylindrical part 8, the diameter of which corresponds to the inner diameter of a smooth-walled tubular blank 9 which has to be corrugated in the apparatus. The head portion 7 has an end face 10 and a frustoconical section 11 is located between the cylindrical portion of the head portion 7 and the end face.

A central bore 12 extends through the shaft portion 6 and part of the head portion 7 and the outer end 13 of the bore 12 is connected to a source of hydraulic pressure fluid, not shown in the drawing. At the transition of the shaft portion 6 to the head portion 7 there is provided a crossbore 14 through which the axial bore 12 communicates with an expansion space 15 to be described later on.

The shaft portion 6 serves to mount and guide substantially without play a tube mandrel or tubular member 16, which is provided adjacent to the head portion 7 with a cylindrical section 17 having a larger diameter than the remainder of the tubular member and corresponding to the inner diameter of the tubular blank 9. The outer end of the tubular member 16 is provided with an annular collar 18 formed with an outer screw thread 19 which serves to fixedly connect to the tubular member 16 a compression or upsetting cylinder 20, arranged coaxial with the tubular member 16 but surrounding the tubular blank 9 with play.

The upsetting cylinder 20 is guided with its right end portion 21, as viewed in the drawing, in a sleeve 20 fixed to and inwardly projecting from the cover 2, whereas the other end section of the upsetting cylinder 20 is provided with an annular enlargement 23, which encompasses a collet 24 threadingly connected at one end to the upsetting cylinder 20. The collet 24 comprises axially extending clamping fingers 25 which are limited tiltable in radial direction and which are distributed uniformly around the circumference of the tubular blank 9.

The clamping fingers 25 are provided with frustoconical outer surfaces 26 tapering toward the connected end of the clamping fingers, whereas the inner surfaces 27 of the clamping fingers are in this region cylindrically formed and the axial length of the surfaces 27 corresponds substantially to the blank supporting, opposite surfaces 17 of the tubular member 16.

The clamping collet 24 is surrounded by an annular clamping piston 28 which is axially guided in the enlarged portion 23 of the upsetting cylinder 20. The clamping piston 28 has in the region of the outer surfaces of the clamping fingers 25 a conically tapering inner surface 29. The clamping piston 28 is further provided at its outer surface and intermediate its ends with an annular collar 30 which sealingly engages in an annular groove 31 provided in the enlarged portion 23 of the upsetting cylinder 20. The annular collar 30 divides the annular groove 31 in two annular spaces 32 and 33 to opposite sides of the annular collar 30 and these spaces are connected through bores 34 and 35 respectively to a hydraulic circuit, not illustrated in the drawing, for alternatingly feeding pressure fluid into and discharging pressure fluid from these spaces.

The outer surface of the sleeve 22 connected to and projecting inwardly from the cover 2 serves also to guide a corrugation cylinder 39 composed of three coaxially interconnected sections 36, 37 and 38 (FIG. 2). The sleeve 22 is provided, substantially midway between the ends thereof, with an annular collar 40 which sealingly engages into a corresponding annular groove 41 provided in the corrugation cylinder 39. The spaces 42 and 43 thus formed to opposite sides of the annular collar 40 are connectable over connecting bores 44, respectively 45, with a hydraulic circuit, not illustrated in the drawing, so that these spaces may be alternately supplied with pressure fluid or pressure fluid discharged therefrom.

As shown in FIGS. 1 and 2, the upsetting cylinder 20 is also provided with an annular collar 46, fixedly connected thereto in any convenient manner, which sealingly engages in an additional annular groove 47 provided in the corrugating cylinder 39. The spaces 48 and 49 thus formed to opposite sides of the annular collar 46 are also connected over bores 50, respectively 51, to a non-illustrated hydraulic circuit for feeding pressure fluid into respectively discharging pressure fluid from these spaces.

A pair of adjusting nuts 52 and 53 are respectively screwed onto the opposite ends of the corrugation cylinder 39, of which the adjusting nut 52 cooperates with the enlarged portion 23 of the upsetting cylinder to adjust the upsetting stroke of the upsetting cylinder 20, whereas the opposite adjusting nut 53 serves to adjust the distance between successive corrugations to be formed in the apparatus.

The cylinders 54 of four, circumferentially through 90° displaced cylinder-and-piston units 55 are connected to the end of the cylindrical housing 1 which is opposite the end in which the cover 2 is mounted. Each cylinder-and-piston unit 55 comprises further a piston 56 guided for reciprocation in the respective cylinder 54 and a piston rod 57 fixedly connecting each piston with a clamping and forming jaw 58. The cylinder spaces 59 and 60 to opposite sides of the piston 56 are provided with connecting bores 61, respectively 62, adapted to be connected to a hydraulic circuit, not illustrated in the drawing, to feed, respectively discharge, pressure fluid into and from the cylinder spaces.

The clamping and forming jaws 58 are guided for radial movement and each of the same is provided with a nose-like projection 61 as well as with a cutout 64 facing the clamping jaws 25. The cutouts 64 form together with the end faces 65 of the clamping fingers 25 a corrugation space 66 in which a corrugation is to be formed.

The above-described apparatus will be operated as follows:

As shown in FIG. 1, the piston 56 are, by feeding pressure fluid through the bore 62 into the cylinder spaces 60, in their radially outer positions so that the clamping and forming jaws 58 are radially spaced from the head portion 7. The pressure space 33 in the enlarged portion 23 of the upsetting cylinder 20 is likewise filled with pressure fluid so that the clamping piston 28 is moved to its right end position and the clamping Figures 25 may, therefore, radially expand. In addition the pressure space 43 in the corrugation cylinder 39 is likewise filled through the bore 45 with pressure fluid, so that the corrugation cylinder 39 is in its left end position, whereas the pressure space 49 in the corrugation cylinder 39 is filled with pressure fluid through the bore 51, so that the upsetting cylinder 20 is in its right end position.

In these positions of the various elements of the apparatus it is possible to insert a tubular blank 9 of pre-cut length over the head portion 7 in proper position into the apparatus.

In order to fix the tubular blank 9 in the desired position, the cylinder spaces 59 of the cylinder-and-piston units 55 are filled through the bores 61 with pressure fluid, so that the pistons 56 move radially inwardly to the position as shown in FIG. 2, whereby the holding and forming jaws 59 press the tubular blank 9 against the head portion 7. At the same time, or shortly thereafter, the pressure space 32 in the enlarged portion 23 of the upsetting cylinder is filled with pressure fluid through the bore 34, so that the clamping piston 28 is moved in direction toward the holding and forming jaws 58, and so that the conical inner surface 29 of the clamping piston 28 presses the clamping fingers 25 against the outer circumference of the tubular blank 9, which is therewith clamped between the tubular member 16 and the collet 24. An expansion space 15 is thus formed between the head portion 7, the tubular member 16 and the tubular blank 9 and this expansion space can be supplied with pressure fluid over the crossbore 14 and the longitudinal bore 12 in the shaft portion 6 of the central pin 3.

FIG. 3 shows the operating condition in which pressure fluid is fed over the longitudinal bore 12 and the crossbore 14 in the expansion space 15, so that the wall of the tubular blank 9 will bulge radially outwardly between the two clamping regions formed on the one hand by the clamping and forming jaws 58 and the head portion 7 and on the other hand by the clamping fingers 25 and the tubular member 16. The magnitude of the pressure in the expansion space 15 is chosen in such a manner that during the outward bulging of the tubular blank 9 no essential decrease of the wall thickness thereof is produced.

Subsequently thereto the pressure space 48 in the corrugation cylinder 39 is filled with pressure fluid through the bore 50, while the inner pressure in the expansion space 15 is maintained, so that the tubular blank 9 clamped between the clamping fingers 25 and the tubular member 16 is moved in the direction toward the head portion 7 (FIG. 4) to thereby produce a first corrugation 67 in the corrugation space 66. The clamping and forming jaws 58 continue to press thereby the end section of the tubular blank 9 against the head portion 7. After the first corrugation 67 is thus produced, pressure fluid is first discharged from the expansion space 15 and subsequently thereto the clamping piston 28 is moved to its right-end position (FIG. 5) by feeding pressure fluid into the pressure space 33 in the enlarged portion 23 of the upsetting cylinder 22, so that the clamping fingers will disengage the tubular blank 9.

If subsequently thereto the pressure spaces 42 and 49 in the corrugation cylinder 39 are filled with pressure fluid, then the corrugation cylinder 39 as well as the upsetting cylinder 20 with its enlargement 23 together with the clamping fingers 25 and the tubular member 16 are moved back toward the right, as viewed in the drawing, through a distance which is equal to the upsetting stroke plus the axial spacing of two successive corrugations. This is illustrated in FIG. 6. The holding and forming jaws 58 remain also during this movement of the other elements pressed against the head portion 7.

Subsequently thereto, the pressure space 32 in the enlarged portion 23 of the upsetting cylinder 20 is again filled with pressure fluid so that the clamping fingers 25 are pressed, as shown in FIG. 7, against the outer periphery of the tubular blank 9 and the latter pressed against the tubular member 16. Thereafter, the cylinder spaces 60 in the cylinder-and-piston unit 55 are filled with pressure fluid so that the holding and clamping jaws 58 are disengaged from the tubular blank 9.

By subsequently feeding pressure fluid into the pressure space 43 in the corrugation cylinder 39 the tubular blank is axially moved, as shown in FIG. 8, toward the head portion 7 through the adjusted corrugation distance. The various members of the apparatus are now brought to the starting position, as shown in FIG. 1, and the above-described cycle of movements is then repeated.

Finally, FIG. 9 shows a corrugated tube 68 after forming the last corrugation. The number of the corrugations may be preselected by a counter in the control of the various hydraulic circuits.

It will be understood that each of the elements described above, or two or more together, may also find a useful application in other types of apparatus for producing a corrugated tube differing from the types described above.

While the invention has been illustrated and described as embodied in an apparatus for producing a tube with successive corrugations of uniform configuration and wall thickness from a tubular blank of constant diameter, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Apparatus for producing a tube with successive corrugations of uniform configuration and wall thickness from a tubular blank of constant diameter, comprising support means; a central pin having an elongated shaft portion fixedly attached only at one end to said support means and having a radially enlarged head portion at the other end; a tubular member mounted on said shaft portion of said central pin for movement in axial direction and adapted to support together with said head portion a tubular blank at the inner surface thereof, said tubular member having one end axially spaced from said head portion to form between said one end and said head portion and a blank supported thereon an annular expansion chamber; first clamping means comprising a plurality of hydraulically operated radially movable holding and forming jaws opposite said head portion; second clamping means comprising a plurality of circumferentially displaced radially tiltable clamping fingers of a collet arranged in the region of said one end of the tubular member about the outer circumference of a blank supported by the latter; a hydraulically operated axial movable annular clamping piston surrounding said clamping fingers for moving the latter between a clamping and a releasing position; an upsetting cylinder connected at one end to the other end of said tubular member and having opposite said one end a radially enlarged end portion surrounding and guiding said clamping piston for movement in axial direction; an axially movable corrugation cylinder surrounding part of said upsetting cylinder and being formed with an annular groove; an annular collar fixed to said upsetting cylinder and located in said annular groove of said corrugation cylinder and forming in said groove two chambers adapted to be alternatingly filled with pressure fluid so as to axially move said upsetting cylinder relative to said corrugation cylinder; and means for feeding pressure fluid into said expansion chamber after axially spaced portions of the blank have been clamped against the head portion and said one end of said tubular member by said first and said second clamping means to expand a portion of said blank clamped between said first and said second clamping means.

2. An apparatus as defined in claim 1, wherein said radially enlarged end portion of said upsetting cylinder is provided with an annular groove and said clamping piston having an annular collar guided in said annular groove and dividing the latter into two chambers adapted to be alternately filled with pressure fluid so as to axially move said clamping piston in one or the opposite direction to thereby move said clamping fingers between a clamping and a releasing position.

3. An apparatus as defined in claim 2, wherein each of said clamping fingers has a part-conical outer surface tapering in a direction away from said head portion and wherein said clamping piston has a conical inner surface cooperating with the outer surfaces of said clamping fingers.

4. An apparatus as defined in claim 1, wherein said tubular member has a radially outwardly projecting annular portion extending for a given distance in axial direction from said one end thereof and wherein each of said clamping fingers has a radially inwardly projecting portion opposite said radially outwardly projecting portion of said tubular member so that a blank located between said clamping fingers and said tubular member will be clamped only between said radially projecting portion.

5. An apparatus as defined in claim 1, wherein said clamping fingers are threadingly connected at one of the ends thereof with said upsetting cylinder.

6. An apparatus as defined in claim 1, wherein said radially enlarged end portion of said upsetting cylinder is arranged substantially coaxial with said corrugation cylinder.

7. An apparatus as defined in claim 1, wherein said corrugation cylinder is provided with a second annular groove axially spaced from said first-mentioned annular groove, and including a sleeve fixedly connected to said support means and having an inner surface guiding said upsetting cylinder and an outer surface guiding said corrugation cylinder for movement in axial direction, said sleeve having an annular collar projecting into said second annular groove of said corrugation cylinder and dividing said second groove into two chambers adapted to be alternately filled with pressure fluid so as to axially move said corrugation cylinder in one and in the opposite direction relative to said sleeve.

8. An apparatus as defined in claim 7, and including a pair of adjusting nuts axially adjustable connected to opposite ends of said corrugation cylinder, one of said nuts abutting against said radially enlarged end portion of said upsetting cylinder and the other facing said support means in which said one end of the central pin is mounted.

9. An apparatus as defined in claim 1, wherein said support means for said one end of said central pin comprises a cover connected to one end of a cylindrical housing closely surrounding said corrugation cylinder and said radial enlargement of said upsetting cylinder and carrying at the other end a plurality of housings in which said holding and forming jaws are respectively guided for movement in radial direction.

10. An apparatus as defined in claim 1, wherein each of said holding and forming jaws has a nose-like projection cooperating with said head portion of said central pin for clamping a tubular blank therebetween and each of said jaws being further provided on the side of said projection facing said clamping fingers with a cut-out forming together with end faces of said clamping fingers a space for forming a corrugation.

11. An apparatus as defined in claim 1, wherein said tubular member is threadingly connected at said other end thereof to said upsetting cylinder.

12. An apparatus as defined in claim 1, wherein said corrugation cylinder is constituted by three coaxially connected annular sections.

* * * * *